US005713695A

United States Patent [19]

Rogers

[11] Patent Number: 5,713,695

[45] Date of Patent: Feb. 3, 1998

[54] TRENCH PLATE CONNECTOR

[76] Inventor: Phillip W. Rogers, P.O. Box 3445, Pahrump, Nev. 89041

[21] Appl. No.: 520,951

[22] Filed: Aug. 30, 1995

[51] Int. Cl.[6] ..... E02D 29/14

[52] U.S. Cl. ..... 404/25; 52/19

[58] Field of Search ..... 52/19, 20; 404/25, 404/26; 137/371; 49/460; 210/164

[56] References Cited

U.S. PATENT DOCUMENTS

| | | | |
|---|---|---|---|
| 2,500,436 | 3/1950 | Swanson . | |
| 3,385,011 | 5/1968 | Sorrell | 52/19 |
| 3,531,149 | 9/1970 | Klueber . | |
| 3,669,486 | 6/1972 | Pasic . | |
| 3,759,559 | 9/1973 | Yuska . | |
| 3,920,347 | 11/1975 | Saurivl et al. | 404/25 |
| 4,192,625 | 3/1980 | Peletz | 404/25 X |
| 4,304,432 | 12/1981 | Silva . | |
| 4,342,178 | 8/1982 | Benton et al. . | |
| 4,398,744 | 8/1983 | Schoppel et al. . | |
| 4,489,970 | 12/1984 | Henke . | |
| 4,737,220 | 4/1988 | Ditcher et al. | 404/25 X |
| 4,938,517 | 7/1990 | Langloy . | |
| 4,940,271 | 7/1990 | Steffes . | |
| 4,941,698 | 7/1990 | Klibert et al. . | |
| 4,974,992 | 12/1990 | Harter | 404/25 |
| 4,992,005 | 2/1991 | Hilfiker . | |
| 5,116,341 | 5/1992 | Cameron . | |
| 5,362,174 | 11/1994 | Yang | 404/25 |
| 5,403,116 | 4/1995 | Brewer | 404/25 |
| 5,529,431 | 6/1996 | Walsh | 52/20 X |

FOREIGN PATENT DOCUMENTS

| | | | |
|---|---|---|---|
| 462054 | 10/1968 | Switzerland | 404/25 |

*Primary Examiner*—James Lisehora
*Attorney, Agent, or Firm*—Quirk & Tratos

[57] ABSTRACT

The present invention is a device providing a safe and convenient attachment point for connecting a lifting apparatus to a trench or cover plate. The invention consists of an insert for location in the plate, the insert having at least two secured pins extending across an aperture centered in the insert. A single length of chain is secured at each end to the portions of the pins spanning the aperture. The chain is of such length and size to fit within the aperture without extending outward from the upper and lower surfaces of the insert. The insert is positioned in an existing cover plate of similar thickness or incorporated into the manufacture of new cover plates. A lifting mechanism is attached to the chain for safe and quick lifting of the cover plate.

10 Claims, 3 Drawing Sheets

TRENCH PLATE CONNECTOR

FIELD OF THE INVENTION

The present invention relates to cover plates used to cover open trenches or other holes. More particularly, the invention is an improved method and device for enabling a user to lift, move and store such plates.

BACKGROUND OF THE INVENTION

In today's modern society buried pipes, wires and fiber optic cables are becoming more and more common. Underground vaults and large covered containers are also becoming more common. Although underground locations provide a convenient out of the way place to run pipes, wires and fiber optic cables, installing and maintaining these pipes, wires and cables pose special problems due to the trench required to house them.

Often the trench, which may be quite deep, must be left open for a number of days and nights while the work is being completed. If not covered, trenches and open vaults or containers interfere with traffic and pose a safety risk to pedestrians. Further, failure to cover a trench or vault will expose existing cables or splices to the elements of nature or vandals. Finally, a trench lacking the proper covering is more likely to cave in from wind or water erosion.

For these reasons, the trenches, holes or vaults are typically covered with large metal trench plates or cover plates. The plates are generally constructed of steel and although varying in thickness are usually about 1"–2" thick and 4–8 feet wide and 8–20 feet long. Due to the plate's size and composition they weigh thousands of pounds.

Presently, two common methods exist for picking up these cover plates. The first, and most common method, requires a worker to place a chain through a pair of centrally located, pre-cut hole in the cover plate. This method poses problems because a worker must upwardly lift the plate a sufficient distance to place the chain under the plate and through the pre-cut holes. Placing the chain under the plate is difficult and dangerous, as the plate, which weighs thousands of pounds, must be pried up and held in place while a worker positions the chain under the plate. Many injuries have occurred from the heavy plate dropping on a workers arm or hand. The chain, once in position, is then hooked to a crane's cable line or back-hoe and lifted into place.

The second method, although safer for the plate movers, comprises a spring loaded loop fastened to the plate. When in position over a trench the loop is forced upward by the force of the spring. During lifting, the crane's cable line attaches to the exposed loop. This spring loaded device is not without disadvantages. The spring loaded loop is designed to retract into the plate upon sufficient downward force. Sometimes, however, this feature malfunctions and does not recess when contacted. Such failure causes damage to automobile tires and may damage the extended spring loaded loop. Similarly, pedestrians or bicyclists may collide with and be injured by the protruding loop.

Additionally, in an effort to conserve space, the steel cover plates are often stacked one on top of another. In this configuration plates possessing only holes are nearly impossible to separate while plates with the spring loaded loop stack unevenly, especially when the spring mechanism is malfunctioning.

SUMMARY OF THE INVENTION

This invention provides a means for lifting cover plates using an easily accessible one point attachment site thereby solving the problems associated with prior trench plate lifting apparatus and methods. The present invention is an apparatus preferably consisting of a square metal plate insert having a top, bottom and four side surfaces for insertion into a cover plate. A square aperture centered and rotationally offset ninety degrees from parallel with the edges of the plate extends through the top and bottom surfaces of the insert thereby creating an aperture through the insert.

Two pins, running in bores, extend from one side surface of the insert, across the aperture and back into the insert a distance sufficient to adequately secure the pins in the insert. The pins enter the insert perpendicular to one of the sides and intersect the aperture a sufficient distance from opposite aperture corners to allow each pin to run through a link of chain.

A single length of chain having ends connected to each of the pins provides a flexible means of attaching a lifting hook, with a crane or back-hoe providing the lifting force. The chain is of such length and size to fit within the confines of the aperture side surfaces and the top and bottom surfaces of the plate. Keeping the chain of such length and size means that no portion of the plate or insert therein extends beyond the flat top or bottom surfaces thereof. This prevents injury to those passing over the plates, and allows a user to stack them flat and level.

Each metal plate insert is secured into the center of a cover plate. Locating the insert in the center of the cover plate aids in keeping the plate level during lifting. Securing the plate insert into the cover plate secures the pins inside the bores in the plate insert.

Accordingly, it is an object of the present invention to provide a one point, easily accessible, safe and secure pick-up point for use when lifting a cover plate. The present invention may be inserted into an existing cover plate or incorporated into new cover plates. These and other objects, features, and advantages of the present invention over the prior art will become apparent from the detailed description of the drawings which follows, when considered with the attached figures.

DESCRIPTION OF THE DRAWINGS

The invention is best understood with reference to the drawings, in which.

DETAILED DESCRIPTION OF THE PREFERRED EMBODIMENT

Figure 1:
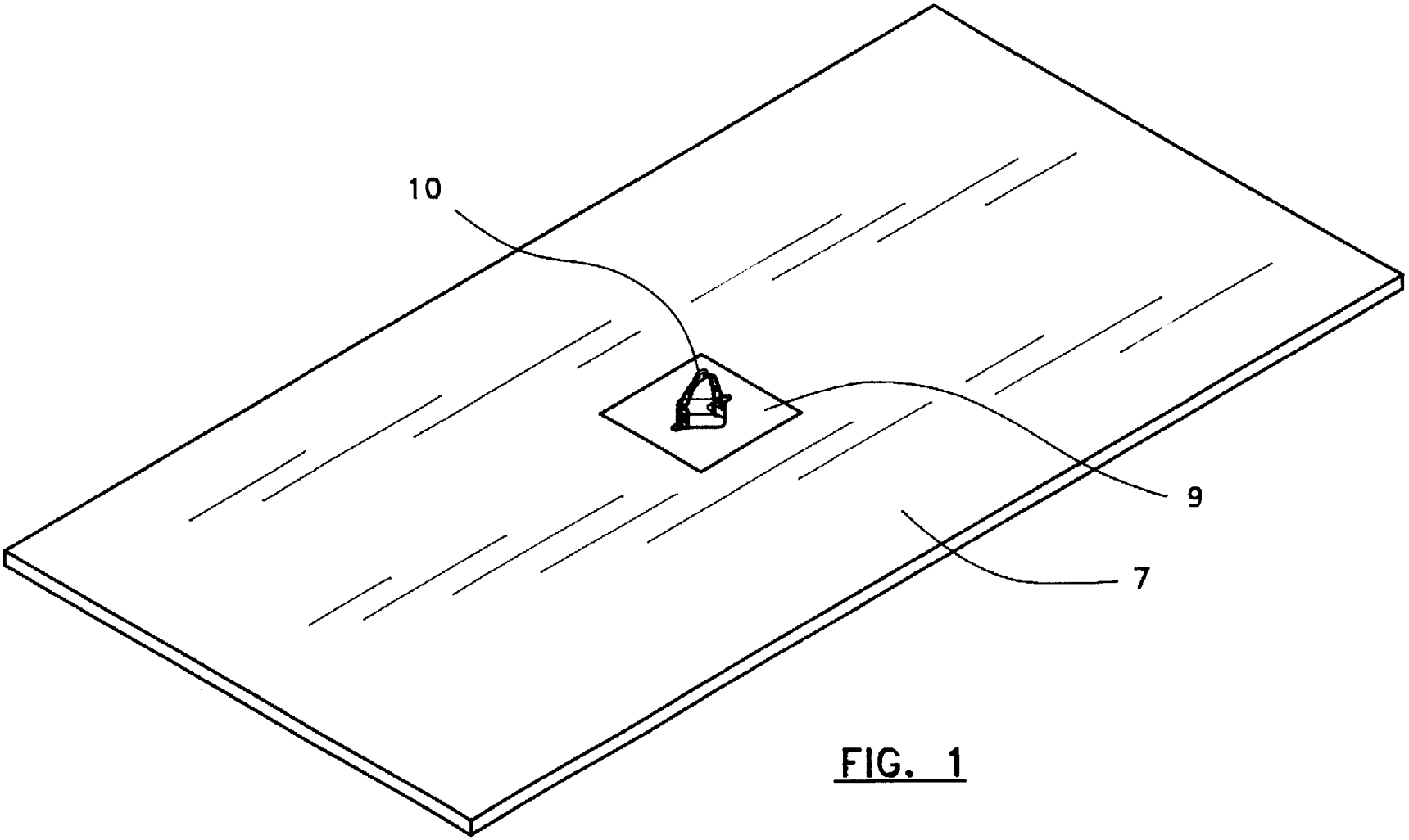
FIG. 1 is a perspective view of the plate insert as secured in a cover plate.

In general, the present invention is a cover plate 7 having an easily accessible one-point pickup point. In a preferred form, a plate insert 9 comprising a metal plate having an aperture 12 therein is positioned in a trench or cover plate 7. The insert 9 includes means for connecting the insert 9 to a crane or similar lifting mechanism. Preferably, these means comprise a length of chain 10 connected to the insert 9 via two pins 14, 15.

In particular, two bores 16, 17 extend into a side 30 of the plate. The two pins 14, 15 are positioned in the bores 16, 17 and extend across the plate insert aperture 12. The length of chain 10 is secured at each end to the exposed portions of the pins 14, 15.

The entire plate insert 9 is centered and secured in a centrally located aperture in the trench plate or cover plate 7. The cover plate 7 is then easily, quickly and safely moved by attaching a line from a back hoe, crane or other lifting mechanism to the chain 10.

As illustrated in FIG. 1, the plate insert 9 of the present invention is shown secured in the cover plate 7. As illustrated in FIGS. 1–5, the plate insert is comprised of a plate insert 9 with the aperture 12 centered in the plate. The plate insert 9 has a top and bottom surface 18, 26 and four side surfaces 30, 32, 34, 36. The aperture 12 is preferably square and rotationally offset ninety degrees from parallel with the edges of the top and bottom surfaces 18, 26 of the plate insert 9.

Figure 4:
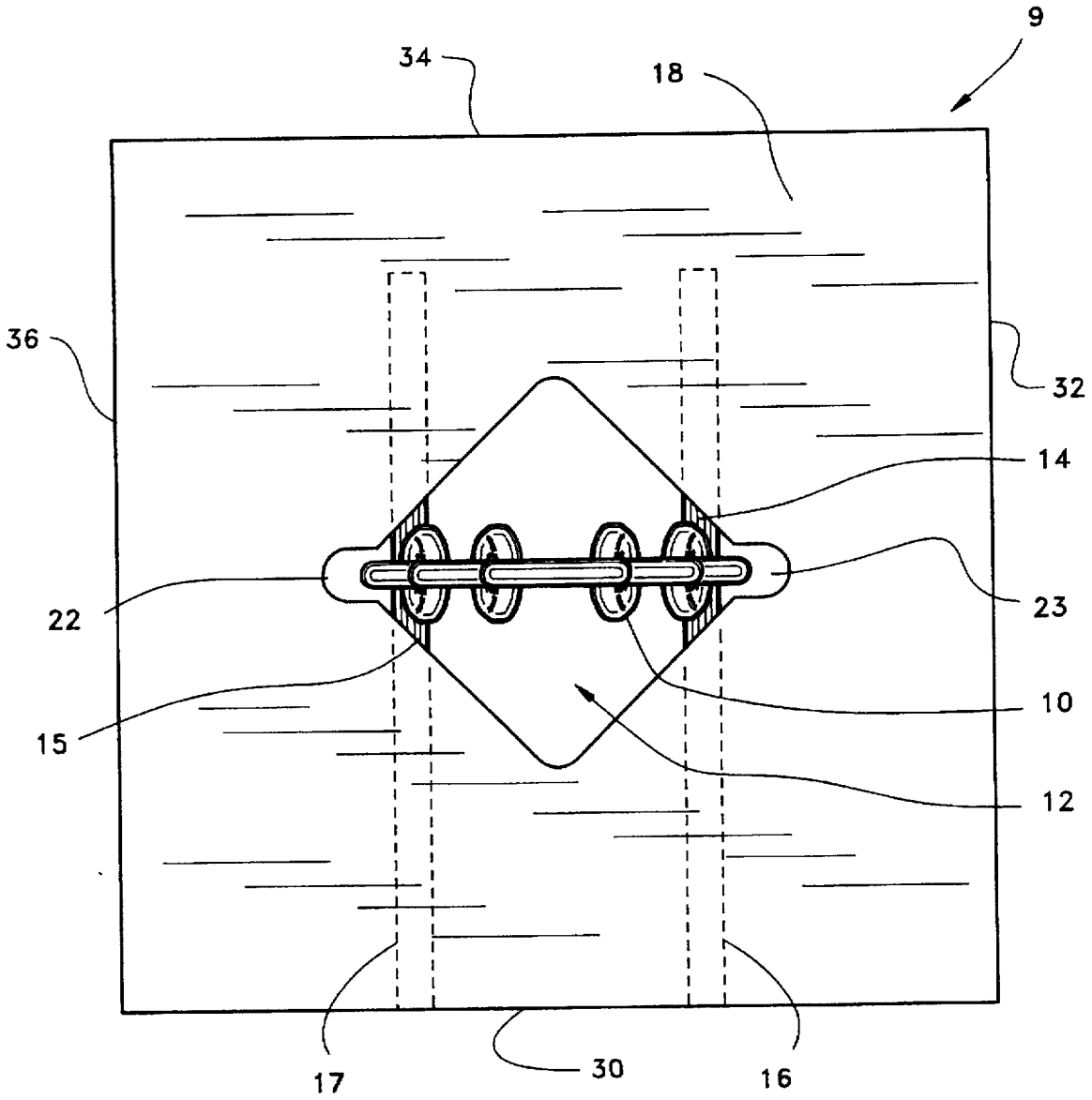
FIG. 4 is a top view of the plate insert.

The plate insert 9, as described above, is preferably square and preferably composed of A36 steel plate. Each side of the plate insert 9 preferably measures seven inches and is of the same thickness as the cover plate 7 into which it is inserted. Each side of the centered square aperture 12 preferably measures two inches. Two opposite corners of the aperture 12 are drilled, creating an one-half inch semi-circular bore 22, 23 through the plate insert 9. These two semi-circular bores 22, 23 provide a channel for a link of chain 10, as best seen in FIG. 4.

Cable mounting means are connected to the insert 9 and extend into the aperture 12. Preferably, the cable mounting means comprises two pins 14, 15 extending through bores 16,17 insert 9 and spanning the aperture 12

The bores 16, 17 are drilled 1⅞ inch from the side surfaces 32, 36 and centered between the top surface 18 and the bottom surface 26 into one of the two sides surfaces 30, 34 furthest from the bored corners 22, 23 of the aperture 12. The two bores 16, 17, also measuring one-half inch in diameter, extend parallel to each other into the plate five inches or a distance sufficient to securely anchor two one-half inch 1018 steel pins 14, 15 which are inserted into the bores.

The pins 14, 15 extend the full length of the bores 16, 17, spanning the aperture 12 and terminating flush with the side surface 30 of the plate insert 9. Flexible cable means are attached to the cable mounting means and for connection to a lifting mechanism. Preferably, this means comprises a single length of link chain 10 secured between each section of pin 14, 15 spanning the aperture 12. The chain 10 is preferably 5/16 inch G80 or G100 alloy chain able to withstand a lifting force of over 22,500 pounds.

Figure 2:
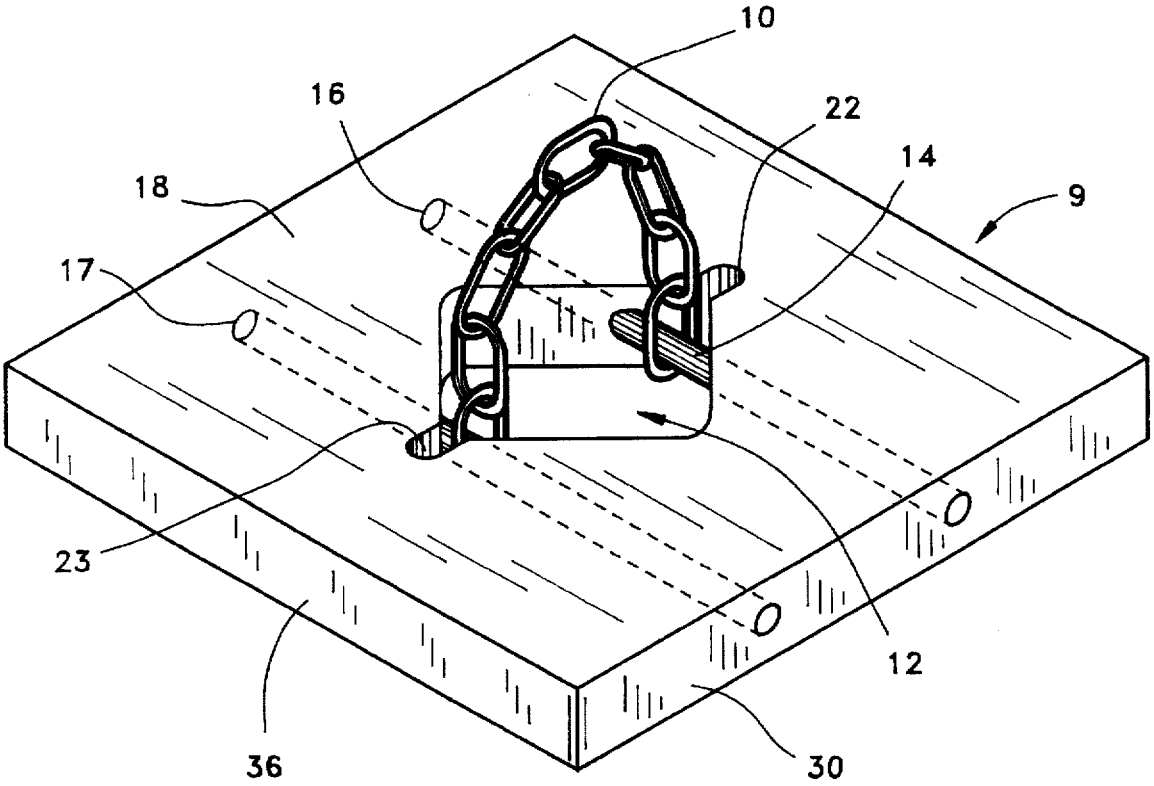
FIG. 2 is a perspective view of the plate insert.
Figure 3:
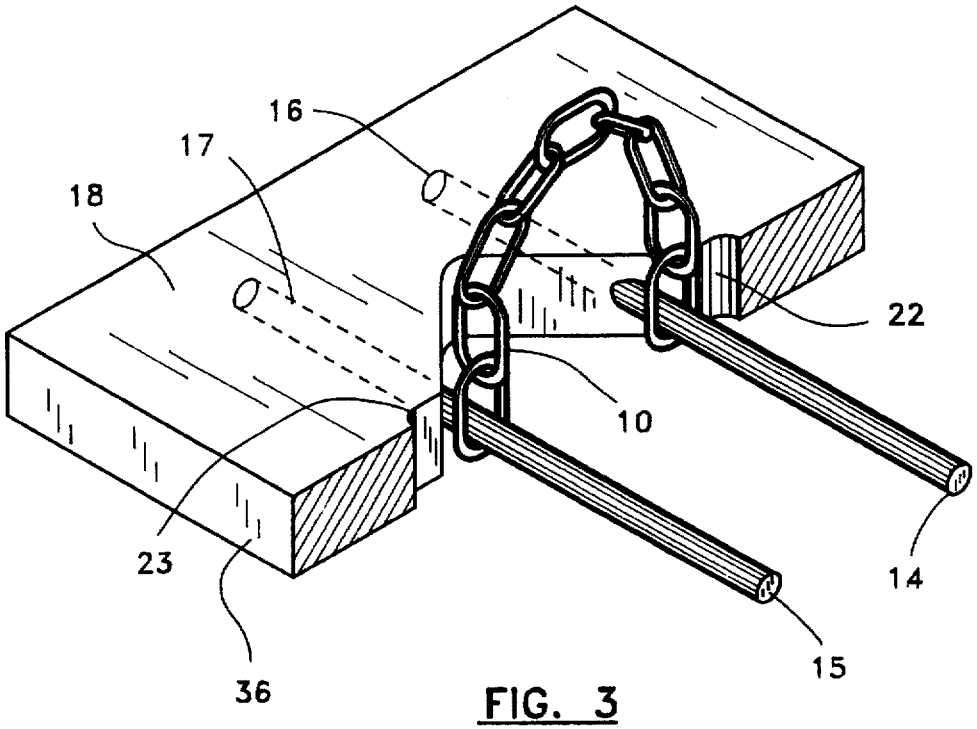
FIG. 3 is sectional perspective view of the plate insert.

One pin 14, 15 runs through the last link on each end of the chain 10 as seen in FIG. 2 and FIG. 3. The length of chain 10 is of such length to be completely contained within the aperture 12 and the top and bottom surfaces 18, 26 of the plate insert 9.

The plate insert 9 is positioned and secured inside a cover plate 7 by creating an aperture of a size similar to the outside dimensions of the plate insert 9 in the center of the cover plate. Preferably, the insert 9 is secured to the cover plate 7 by welding. Once the plate insert 9 is secured the pins 14, 15 may not be removed from the plate insert due to their obstruction by the cover plate.

In use, a worker attaches a lifting mechanism (not shown), such as a hook on a crane or back-hoe, to the chain 10. The attachment, performed by single person, is fast, safe and requires no special devices or tools. The operator of the crane or back-hoe lifts and positions the cover plate 7. Once in position, the user releases the chain 10 from connection to the lifting apparatus, allowing the chain 10 to fall into the aperture 12.

Figure 5:
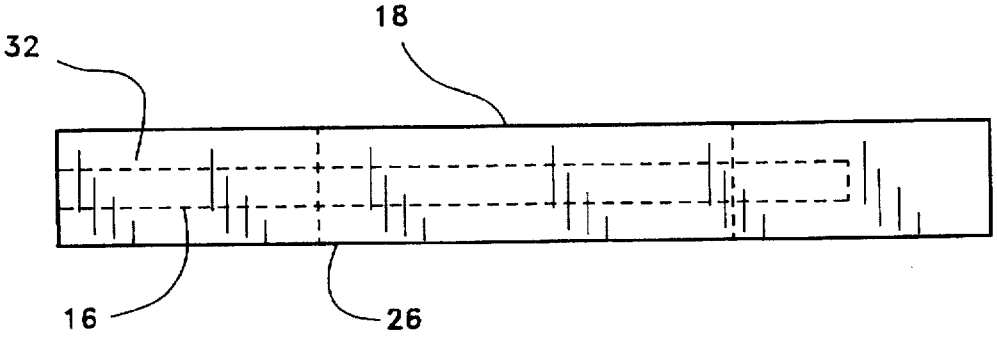
FIG. 5 is a side view of the plate insert.

When the chain 10 is located in the aperture 12, the chain is located out of the way of automobile, bicycle and pedestrian traffic. In fact, nothing which would interfere with traffic protrudes from the cover plate 7, as the cover plate 7 presents a flat upper and lower surface, as illustrated in FIG. 5. This fact also allows a user to stack numerous plates 9 on top of another.

Further, unlike prior plates incorporating a spring-loaded loop which must always be oriented "top-side" up, the plates of the present invention may be oriented such that either the "top" or "bottom" surface faces upwardly since both surfaces are flat. At the same time, the plate can easily be picked up and moved when either side faces upwardly.

When the cable mounting means comprises a chain, a user can attach a lifting mechanism to the chain in a variety of orientations. This allows a user to pick up the plate in a variety of positions. For example the user may connect the lifting mechanism to the center of the chain to pick up the plate flat, or may connect the lifting mechanism towards one end of the chain to lift the plate at an angle.

While the preferred means for connection comprises a length of chain 10 connected to two pins, other means, including but not limited to cable, wire, strapping, or a solid cross brace may be employed. Also, two smaller chains might be substituted for the single large chain described above.

Furthermore, the cable mounting means may comprise a single pin or three or more pins in various configurations, instead of two pins 14, 15. Moreover, the pins need not span the aperture 12. For example, the pins might simply extend outwardly from the insert 9 into the aperture 12 and be connected to the chain 10 via welding or with a eyelet located on the end thereof. Also, both ends of the chain need not be anchored to the insert. One end of the chain 10 might be anchored to the insert 9 and the other simply comprise an oversized loop of metal to which a crane hook or similar item may be connected.

The plate insert 9 may be located, instead of at the center of the cover plate 7, near one of the sides of the cover plate. This alternative embodiment may cause the plate to tilt when lifted and facilitate stacking the cover plates 7 on their sides.

While the insert 9 described above has a square outer perimeter, the insert 9 may have a variety of other shapes such as round, triangular or rectangular. Further, the aperture 12 in the insert 9 need not be square, but may have a variety of other shapes. Preferably, the aperture is simply large enough to house a chain 10 or similar means for connection to a lifting mechanism, and at the same time be small enough that a person's foot, a bicycle tire or the like does not become readily lodged therein.

The insert 9 need not have the same thickness as the plate 7 in which it is located. While it is possible for the insert 9 to have a thickness greater than the plate 7, this is not normally desirable because the insert 9 then extends outwardly of the flat surfaces of the plate. On the other hand, it is possible for the insert 9 to be thinner than the plate 7.

The dimensions of the insert 9, aperture 12, pins and bores, as well as their locations, need not be exactly as described above. Such is merely illustrative of one specific version which has been found useful.

It is possible to construct a plate 7 in accordance with the present invention without an insert 9. In particular, a manufacturer may form an aperture in a plate and connect the cable mounting means and flexible cable means directly thereto. For example, the manufacturer may make bores in the plate and slide the pins therein and weld them to the plate.

While this invention is designed and described for use in connection with a trench plate or cover plate 7, it may be used as a quick, safe and convenient pick up apparatus for many other types of plates, covers, lids or weighty items.

It will be understood that the above described arrangements of apparatus and the method therefrom are merely illustrative of applications of the principles of this invention and many other embodiments and modifications may be made without departing from the spirit and scope of the invention as defined in the claims.

I claim:

1. An insert for a cover plate having a thickness dimension comprising:

a rigid insert having planar upper and lower surfaces defining a thickness for the insert substantially equal to the thickness of the cover plate and having perimeter dimensions to be received into a cover plate opening, said insert having a central aperture through its thickness;

said aperture is square and has first, second, third and fourth corners and a first pin spans said aperture near said first corner and a second pin spans said aperture near said second corner and wherein a pair of semicircular bores extend through the insert at said first and second corners; and flexible cable means attached to said first and second pins for lifting the cover plate, said means storable in the aperture without extending outwardly of the upper and lower surface of the insert.

2. A cover plate adapted to be lifted by lifting means comprising:

an insert having upper and lower surfaces and an insert aperture therethrough, said insert secured to the cover plate in a central opening thereof;

a pair of spaced pins disposed to transect said aperture; and flexible cable means having each end thereof connected to a pin within said insert aperture for lifting the cover plate, said means adapted to collapse into the insert aperture for storage thereof without extending outwardly of the upper and lower surfaces of the insert and to be retrieved from the aperture for connection to lifting means for lifting of the cover plate.

3. The insert of claim 2 wherein said pins are located in two bores, said bores running from a side surface of the insert across the aperture and into the insert.

4. The improved cover plate of claim 2 wherein the insert has a perimeter and the cover opening corresponds to said perimeter to closely receive the insert, the cover plate further including a weld connection between the insert perimeter and the plate.

5. The improved cover plate of claim 4 wherein the cover plate has a substantially uniform thickness, said insert upper and lower surfaces defining a thickness for the insert corresponding to the thickness of the cover plate whereby said upper and lower surfaces are substantially flush with those of the cover plate.

6. The insert of claim 5 wherein said insert has four sides forming a square perimeter, and said aperture is square and rotated 90 degrees from parallel with respect to the sides of the insert.

7. An insert for a cover plate comprising:

a rigid insert having planar upper and lower surfaces defining a thickness for the insert substantially equal to the thickness of the cover plate and having four sides forming a square perimeter, said insert having a square aperture rotated 90 degrees from parallel with respect to the sides of the insert;

cable mounting means extending into the aperture; and flexible cable means for lifting the cover plate having at least one end portion thereof attached to the cable mounting means, said cable means being storable in the aperture without extending outwardly of the upper and lower surfaces of the insert.

8. A cover plate adapted to be lifted by lifting means comprising:

an insert having upper and lower surfaces and an insert aperture therethrough, said insert secured to the cover plate in a central opening thereof;

a pair of spaced pins disposed to transect said aperture; and a chain having a link proximate at each end passing a pin within said insert aperture, said chain adapted to collapse into the insert aperture for storage thereof without extending outwardly of the upper and lower surfaces of the insert and to be retrieved from the aperture for connection to lifting means for lifting of the cover plate.

9. A method for fashioning a trench plate having a top surface and a bottom surface comprising:

providing a rigid insert having an aperture;

securing a pair of anchor pins to transect the aperture;

attaching flexible cable means for lifting the plate and for collapsible storage thereof into the aperture and retrieval therefrom between said pins; and cutting an opening in the trench plate and mounting said insert into said opening.

10. The method of claim 9 wherein the mounting step includes welding the perimeter of the insert into the trench plate opening.

* * * * *